US006575791B1

(12) United States Patent
Korsunsky

(10) Patent No.: US 6,575,791 B1
(45) Date of Patent: Jun. 10, 2003

(54) ELECTRICAL CONNECTOR PROVIDING RELIABLE ELECTRICAL INTERCONNECTION WITH MATED DEVICES

(75) Inventor: Iosif Korsunsky, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/095,983

(22) Filed: Mar. 11, 2002

(51) Int. Cl.[7] ..... H01R 24/00
(52) U.S. Cl. ..... 439/637; 439/515
(58) Field of Search ..... 439/637, 636, 439/660, 260, 515

(56) References Cited

U.S. PATENT DOCUMENTS 5,823,823 A * 10/1998 Longueville et al. ..... 439/571
6,206,713 B1 * 3/2001 Baertsoen et al. ..... 439/260

* cited by examiner

*Primary Examiner*—Gary V. Paumen
(74) *Attorney, Agent, or Firm*—Wei Te Chung

(57) ABSTRACT

An electrical connector (1) includes an elongate insulative housing (12) defining a number of cavities (22) in a longitudinal direction (X) thereof, a number of groups of contacts (12) respectively received in corresponding individual cavities of the housing. The groups of contacts are arranged in two rows in a traverse direction (Y) of the housing. Each group of contacts includes at least two conductive contacts gathered side by side in the corresponding individual cavity in the X direction. The contacts each are such stamped and assembled to the housing that its dimension (T) in the X direction is much less than its dimension (W) in the Y direction, which reduces its occupied room in the housing in the X direction without reducing its strength.

1 Claim, 4 Drawing Sheets

ELECTRICAL CONNECTOR PROVIDING RELIABLE ELECTRICAL INTERCONNECTION WITH MATED DEVICES

BACKGROUND OF THE INVENTION

1. Field of the Invention

The present invention relates to an electrical connector, and particularly to an electrical connector that provides more than one conductive contacts in a single contact receiving cavity of an insulative base which electrically contact a same conductive pad on a first printed circuit board to a same conductive pad on a second printed circuit board with multiple contacting points.

2. Description of the Related Art

Usually, in an electrical connector with multiple contacts in rows, each contact is placed in an individual cavity and is electrically connected to one of the conductive pads on corresponding mother and daughter PC boards. In high speed applications, in order to improve the reliability of the electrical interconnections between the contacts of the connector and the conductive pads on the mother and daughter PC boards, there is a desire that each contact has a portion with redundant beams electrically touching a same one of the conductive pads on the daughter or mother PC board to therefore provide multiple electrical contacting points between the conductive contact and the same one conductive pad, such that when one of the redundant beams electrically isolates from the same one conductive pad, the contact still can touch the same one conductive pad via the other beam(s). However, for high density and high speed electrical connectors, for example, the pitch between two adjacent contacts being less than 0.5 mm and signal transmission speed through the contact being above 1.0 Gigabyte/second, there is not enough room in a direction that the contacts are aligned in rows for accommodating the contacts with redundant beams. U.S. Pat. Nos. 5,823,823 and 6,206,713 each disclose that two conductive contacts are received in a single cavity of an insulative housing. However, the two conductive contacts are spaced away from each other and joined together via an insulator. Further, the above two patents do not disclose that the two conductive contacts in the single cavity electrically contact a single conductive pad on a PC board for providing multiple contact points purpose. Therefore, the above two patents still do not solved the above issue. This invention is aimed to address this issue.

SUMMARY OF THE INVENTION

An object of the present invention is to provide an electrical connector that provides more than one conductive contacts in a single contact receiving cavity of an insulative base which electrically contact for instance a same conductive pad on a first printed circuit board to a same conductive pad on a second printed circuit board with multiple contacting points.

To obtain the above object, an electrical connector includes an elongate insulative housing defining a plurality of cavities in a longitudinal direction thereof, a plurality of groups of contacts respectively received in corresponding individual cavities of the housing. The groups of contacts are arranged in two rows in a traverse direction of the housing. Each group of contacts includes at least two conductive contacts gathered side by side in the corresponding individual cavity in the longitudinal direction of the housing. The contacts each are stamped and assembled into the housing that its dimension in the longitudinal direction is much less than its dimension in the traverse direction, which reduces the room of the housing in the longitudinal direction without reducing the strength of the contact. Thus, the issue in the prior art is addressed.

In a second embodiment of this invention, the contacts are made from conductive wires which may reduce the manufacturing cost greatly.

The multiple contacting points concept of this invention may be applied to board to board connector, cable connector, line grid array (LGA) connector and any other connectors requiring multiple contacting points with mating devices.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
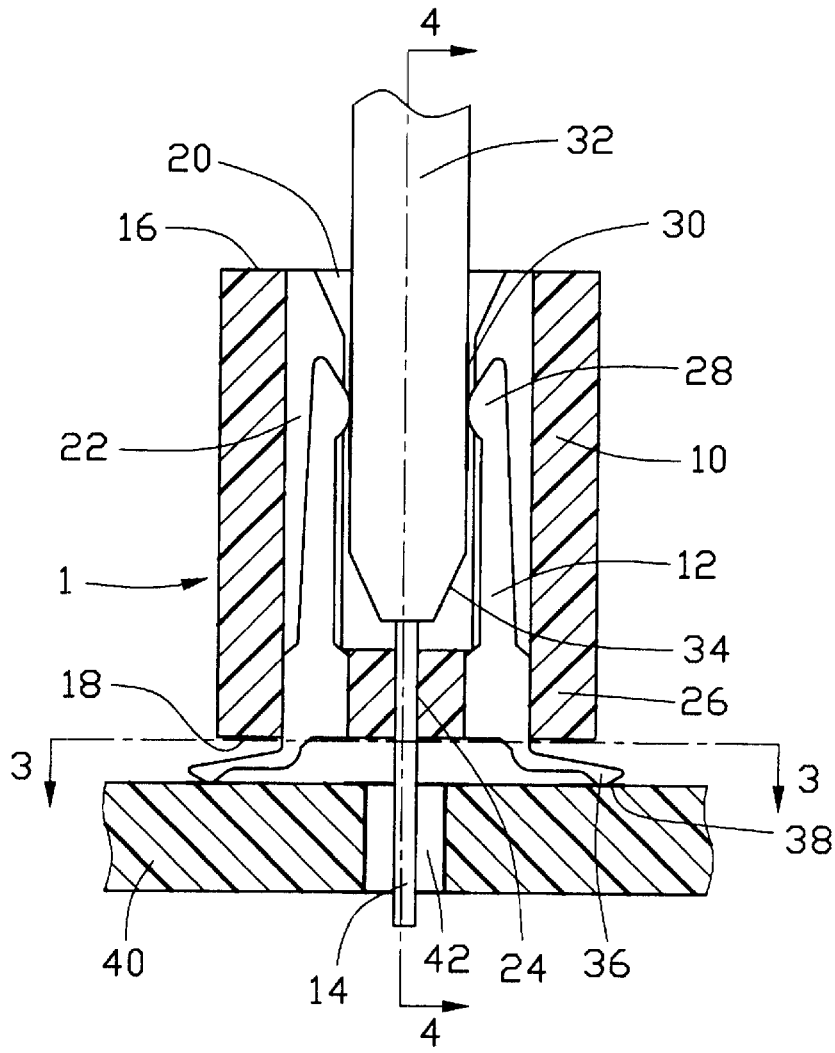
FIG. 1 is a cross-sectional view of an assembly of an electrical connector, a mother board and a daughter board in accordance with a preferred embodiment of the present invention.

Referring to FIG. 1, an electrical connector 1 in accordance with the present invention comprises an insulative housing 10, a plurality of conductive contacts 12 received in the housing and a plurality of fasteners 14 retained to the housing. The housing 10 includes a top surface 16 and an opposite bottom surface 18 and defines a slot 20 and a plurality of contact receiving cavities 22. The contact receiving cavities 22 are communicated with the slot 20. The housing 10 further defines a plurality of holes 24 in a bottom portion 26 thereof along a longitudinal direction, designated by "X" (FIG. 5) in which the fasteners 14 are fixedly received. Each conductive contact 12 includes a mating portion 28 extending into the slot 20 for electrically contacting first conductive pad 30 on a daughter board 32 whose edge 34 is received in the slot 20. Each conductive contact 12 further includes an opposite mounting portion 36 downwardly extending beyond the bottom surface 18 of the insulative housing 10 for electrically contacting second conductive pad 38 on a mother board 40. The mother board 40 defines a number of openings 42 with solder pads 43 on peripheral walls thereof aligned with the holes 24 of the insulative housing 10 so that the fasteners 14 may be correctly fixed into the openings 42.

Figure 2:
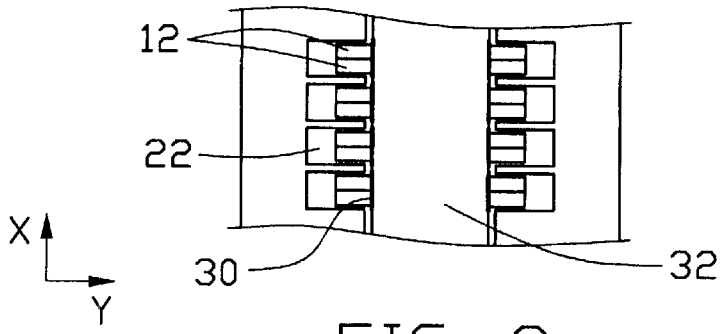
FIG. 2 is a partial top planar view of FIG. 1.
Figure 3:
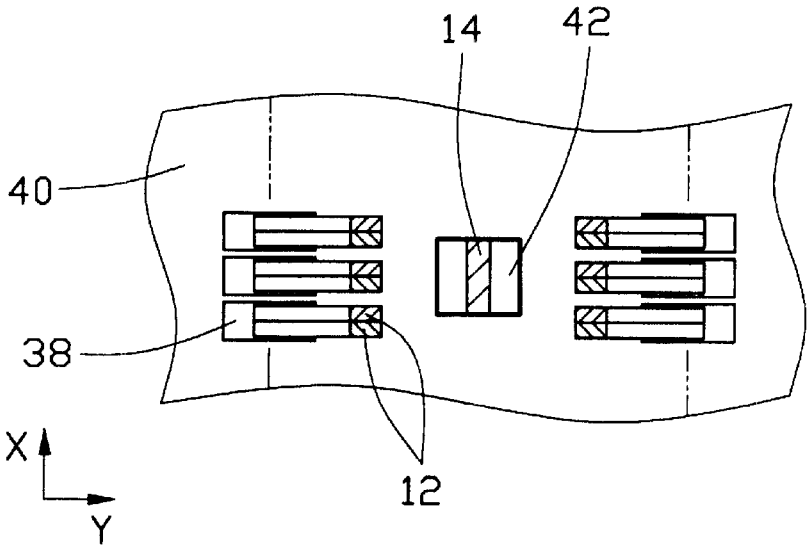
FIG. 3 is a partial cross-sectional view taken from line 3—3 of FIG. 1.

Referring to FIGS. 2 and 3, each contact receiving cavity 22 receives two conductive contacts 12 arranged side by side in the "X" direction. The two conductive contacts 12 are preferably conductive to each other, however, they may also be isolated from each other by insulative material positioned therebetween. The mating portions 28 and the mounting portions 36 of the two conductive contacts 12 in a same contact receiving cavity 22 are electrically contacted to a same first conductive pad 30 on the daughter board 32 and a same second conductive pad 38 on the mother board 40, respectively. This structure provides multiple contact points between the conductive contacts 12 and the first and the second conductive pads 30, 38. So, should one of the two conductive contacts 12 do not reliably contact the conductive pad 30/38, the other conductive contact 12 may reliably contact the conductive pad 30/38, therefore improving the reliability of the electrical interconnection between the conductive contact 12 and the conductive pad 30/38.

Figure 4:
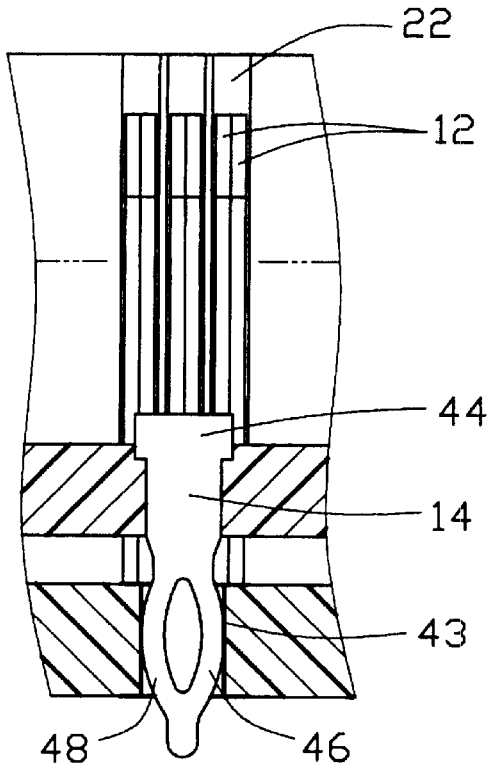
FIG. 4 is a partial cross-sectional view taken from line 4—4 of FIG. 1.
Figure 5:
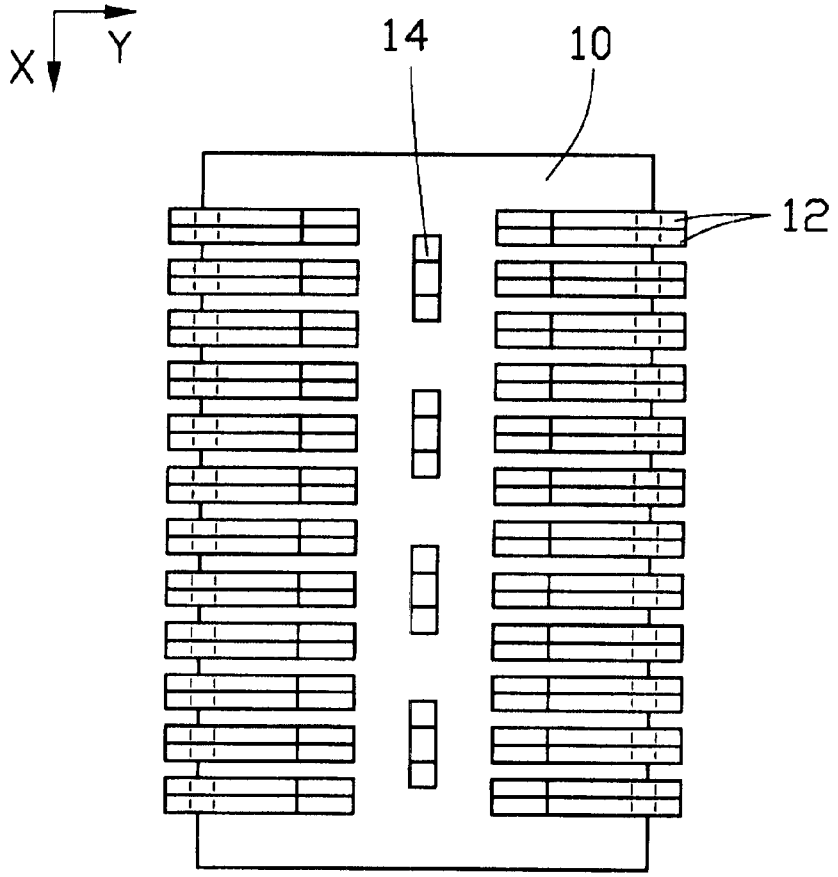
FIG. 5 is a reduced bottom planar view of FIG. 1.

Referring to FIGS. 4 and 5, each fastener 14 has a retention portion 44 fixed to the bottom portion 26 of the housing 10 and an opposite tail portion 46 engageably received in the opening 42 of the mother board 40. The tail portion 46 has two branches 48 compliantly bearing against the solder pads 43 in the opening 42, therefore retaining the fastener 14 to the mother board 40. If desired, solder may be added into the opening 42 to even more reliably retaining the tail portion 46 of the fastener 14 into the opening 42. The conductive contacts 12 are arranged in two rows along a traverse direction of the housing 10 designated by "Y". The fasteners 14 are aligned along the "X" direction and located between the two rows of conductive contacts 12 and do not extend beyond opposite ends of the rows. Each fastener 14 is such fixed to the housing 10 that its dimension in the "X" direction is larger than its dimension in the "Y" direction.

Figure 6:
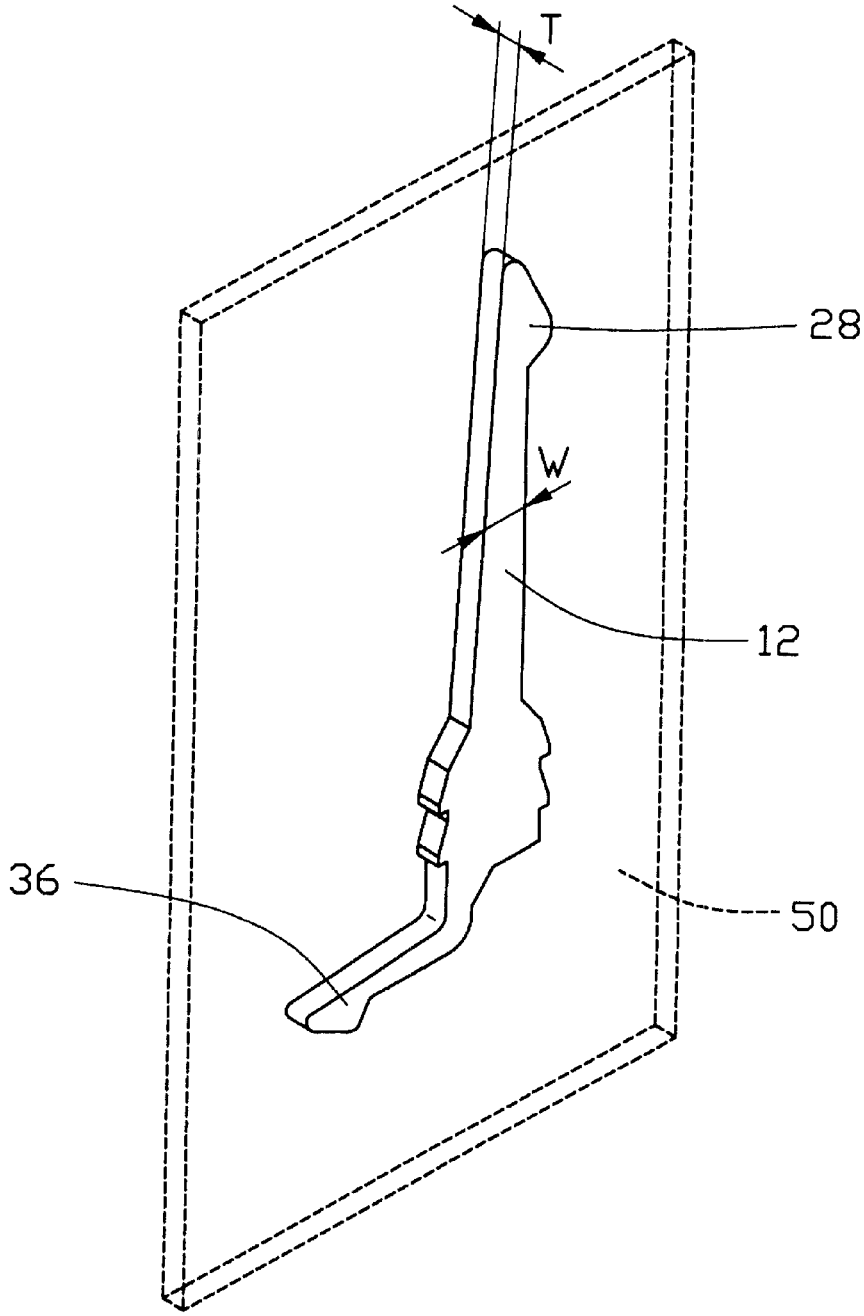
FIG. 6 is a drawing for illustrating how the contacts of the connector are manufactured.

Referring to FIG. 6, the conductive contact 12 is blanked from a metal sheet 50 in a direction perpendicular to the metal sheet to form a configuration that its width, designated by "W", is larger than its thickness, designated by "T", which is exactly the thickness of the metal sheet 50. The thickness "T" is determined by the metal sheet 50 and the width "W" is changeable in the stamping die. The thickness "T" can be very small to occupy less room in the "X" direction such that two or more contacts 12 can be received in an individual cavity 22 for a given spacing between two adjacent cavities 22. Conductive material, for example gold, may be applied to the mating portions 28 of the contacts 12 and the conductive pads 38 of the daughter board 32 to help for better contacting connection and electrical performance.

In a second embodiment of this invention, the conductive contacts may be made from conductive wires which are bent to required configurations and then assembled into the insulative housing. The multiple contacting points concept may be applied to board to board connector, cable connector, line grid array (LGA) connector and any other connector requiring multiple contacting points.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a plurality of conductive contacts; and an insulative housing defining a plurality of contact receiving cavities, at least one contact receiving cavity receiving more than one conductive contacts, the conductive contacts in the at least one contact receiving cavity being arranged side by side along a longitudinal direction of the insulative housing for electrically contacting a first conductive element to a second conductive element with multiple contacting points;

wherein the conductive contacts extend beyond a bottom surface of the insulative housing for elevating the insulative housing a predetermined distance above the second conductive element;

wherein at least parts of the conductive contacts in the at least one contact receiving cavity physically engage each other;

wherein the conductive contacts in the at least one contact receiving cavity are conductive to each other;

wherein the conductive contacts are blanked from a metal sheet;

wherein the conductive contacts are formed from conductive wires;

wherein the insulative housing defines a slot and the conductive contacts partially extend into the slot for electrically contacting the first conductive elements in the slot;

wherein opposite distal ends of each conductive contact extend beyond respective opposite surfaces of the insulative housing for electrically contacting the first and the second conductive elements.

* * * * *